US009050608B2

(12) United States Patent
Rosenblum et al.

(10) Patent No.: US 9,050,608 B2
(45) Date of Patent: Jun. 9, 2015

(54) VERTICAL PLATE CENTRIFUGE

(75) Inventors: Michael D. Rosenblum, Hoboken, NJ (US); H. Gerald Young, South Plainfield, NJ (US)

(73) Assignee: CORNING INCORPORATED, Corning, NY (US)

( * ) Notice: Subject to any disclaimer, the term of this patent is extended or adjusted under 35 U.S.C. 154(b) by 1226 days.

(21) Appl. No.: 12/807,596

(22) Filed: Sep. 9, 2010

(65) Prior Publication Data

US 2011/0118099 A1 May 19, 2011

Related U.S. Application Data

(62) Division of application No. 12/317,880, filed on Dec. 30, 2008, now abandoned.

(51) Int. Cl.

| | |
|---|---|
| ***B04B 5/02*** | (2006.01) |
| ***B04B 7/06*** | (2006.01) |
| ***B04B 5/04*** | (2006.01) |
| ***B04B 7/02*** | (2006.01) |
| ***B04B 9/08*** | (2006.01) |

(52) U.S. Cl.

CPC ..... *B04B 5/0414* (2013.01); *B04B 7/02* (2013.01); *B04B 7/06* (2013.01); *B04B 9/08* (2013.01)

(58) Field of Classification Search

CPC .... B04B 5/04; B04B 5/0407; B04B 2005/04; B04B 2005/0407

USPC ..... 494/13–14, 16–21, 23, 25–26, 60, 12; 422/72

See application file for complete search history.

(56) References Cited

U.S. PATENT DOCUMENTS

| | | | | |
|---|---|---|---|---|
| 2,827,229 A | | 3/1958 | Blum | |
| 3,028,075 A | | 4/1962 | Blum | |
| 3,744,710 A | * | 7/1973 | McCartney | 210/363 |
| 3,747,841 A | | 7/1973 | Ross | |
| 3,891,140 A | | 6/1975 | Ayres | |
| 4,019,763 A | | 4/1977 | Webb | |
| 4,341,342 A | * | 7/1982 | Hara | 494/16 |
| 4,412,830 A | | 11/1983 | Strain | |

(Continued)

FOREIGN PATENT DOCUMENTS

| | | |
|---|---|---|
| JP | 64-1746 | 1/1989 |
| JP | 2005-287616 | 10/2005 |

OTHER PUBLICATIONS

Website print-out for "Finnzymes PIKO Microcentrifuge"—dated Mar. 17, 2009. (1 page).

(Continued)

*Primary Examiner* — Charles Cooley
(74) *Attorney, Agent, or Firm* — Michael Russell

(57) ABSTRACT

A Microtiter plate centrifuge is disclosed. The centrifuge includes a motor assembly, a rotor assembly attached to the motor assembly via a shaft, the rotor assembly including at least two slots, symmetrically positioned, with respect to the shaft and a channel corresponding to each of said slots. The channels extending from the rotor assembly are suitable for holding Microtiter plates in a vertical position. Also included is a bottom plate engaging a brake pad, which when engaged creates sufficient friction to halt rotation of the rotor assembly.

17 Claims, 6 Drawing Sheets

(56) References Cited

U.S. PATENT DOCUMENTS

| | | | | |
|---|---|---|---|---|
| 4,534,755 | A | 8/1985 | Calvert | |
| 5,242,370 | A * | 9/1993 | Silver et al. | 494/11 |
| 5,409,443 | A | 4/1995 | Zabriskie et al. | |
| 5,605,529 | A | 2/1997 | Petithory | |
| 5,679,154 | A | 10/1997 | Kelley et al. | |
| 6,416,455 | B1 * | 7/2002 | Aizawa et al. | 494/16 |
| 7,371,205 | B2 * | 5/2008 | Andersson et al. | 494/14 |
| 2005/0043163 | A1 * | 2/2005 | Malugvist et al. | 494/14 |
| 2006/0142134 | A1 * | 6/2006 | Andersson et al. | 494/14 |
| 2010/0167900 | A1 * | 7/2010 | Rosenblum et al. | 494/12 |
| 2011/0118099 | A1 * | 5/2011 | Rosenblum et al. | 494/12 |

OTHER PUBLICATIONS

Hettich Zentrifugen Brochure. (undated) (6 pages).

Eppendorf Microcentrifuge 5430 Brochure. (undated) (6 pages).

Labnet International, Inc. Spectrafuge Mini Centrifuge Brochure. (USA) (undated) (1 page).

Website print-out for www.HandyFuge.com—dated Sep. 7, 2010. (2 pages).

International Search Report, (from related International Application No. PCT/US09/06724—dated Mar. 23, 2010. (2 pages).

English translation of JP 2005-287616 (13 pages) (Oct. 20, 2005).

Partial English translation of JP 64-1746 (1 page) (Jan. 6, 1989).

* cited by examiner

VERTICAL PLATE CENTRIFUGE

RELATED APPLICATIONS

This application is a continuation-in-part of, and claims priority under 35 U.S.C. §120 to U.S. application Ser. No. 12/317,880, filed on Dec. 30, 2008, now abandoned, and under 35 U.S.C. §119 to International Application No. PCT/US2009/006724, filed on Dec. 28, 2009, the entire disclosures of which are hereby incorporated by reference herein.

FIELD OF THE INVENTION

This invention relates to the field of centrifuge medical devices and, more particularly, to Microtiter plate centrifuges.

BACKGROUND OF THE INVENTION

Methods for separating solid components from fluid are well-known in the medical arts, for example. In application, vials are placed in tube sleeves of a centrifuge and are then spun at various speeds. The centrifugal force generated by the spinning vials causes the heavier particles within the vial to be forced to the outer edge or lower part of the vial.

In another type of centrifuge, for spinning Microtiter and/or PCR plates, the Microtiter and/or PCR plates are placed horizontally in swinging trays and are then spun up to a substantially vertical position. PCR plates represent a specific type of Microtiter plate that is made of thin plastic that allows fast transfer of heat to samples and, thus, they work well for Thermal Cycling applications.

The swing out trays are typically sized to fit common sample plates, whether Microtiter or PCR. However, such Microtiter and/or PCR plate centrifuges are relatively large and heavy, e.g., having an approximate 14 inch×14 inch footprint or larger; are expensive; are complicated to operate as speed and run time must be programmed; have a relatively long processing time as the large swing out rotor requires 20 to 40 seconds to reach speed and an equal amount of time to decelerate to a stop and require substantial safety features, such as a lid latching system.

Hence, there is a currently a need for a lightweight and simple to operate Microtiter plate centrifuge.

SUMMARY OF THE INVENTION

A Microtiter plate centrifuge is disclosed. The centrifuge includes a motor assembly with a shaft, extending vertically from the motor assembly, a rotor assembly, attached to the shaft, the rotor assembly including at least two slots, symmetrically positioned, with respect to the shaft and a channel corresponding to each of said slots. The channels extending from the rotor assembly are suitable for holding Microtiter plates in a vertical position. Also included is a bottom plate engaging a brake pad, which when engaged creates sufficient friction to halt rotation of the rotor assembly.

According to another aspect of the invention, a Microtiter plate holding centrifuge includes a motor assembly; a rotor assembly coupled to the motor assembly via a substantially vertically-extending shaft of said rotor assembly, the rotor assembly including a rotor plate disposed adjacent an end of the shaft; and at least two vertical chambers extending in a perpendicular direction from a surface of the rotor plate, the at least two chambers substantially symmetrically positioned in parallel with respect to the shaft, each of the at least two chambers including a slot for receiving a Microtiter plate.

According to another aspect of the invention, a vertical Microtiter plate centrifuge assembly includes a housing including an opening; a lid coupled to the housing for covering the opening in the housing; and means for opening and closing the lid; a centrifuge assembly disposed within the housing, the centrifuge assembly including a motor assembly attached to and vertically positioned with respect to a bottom of the housing; a rotor assembly coupled to the motor assembly via a substantially vertically-extending shaft of said rotor assembly, the shaft having a first end and a second end, the rotor assembly including a rotor plate disposed adjacent the first end of the shaft; at least two vertical chambers extending in a perpendicular direction from a surface of the rotor plate, the at least two chambers substantially symmetrically positioned in parallel with respect to the shaft, each of the at least two chambers including a slot for receiving a Microtiter plate; and means for applying a voltage to the motor assembly.

According to another aspect of the invention, a method for centrifuging Microtiter plates includes disposing at least two Microtiter plates containing sample substances into a centrifuge, the centrifuge including a motor assembly; a rotor assembly coupled to the motor assembly via a substantially vertically-extending shaft, the rotor assembly including a rotor plate disposed adjacent an end of the shaft; and at least two vertical chambers extending in a perpendicular direction from a surface of the rotor plate, the at least two chambers substantially symmetrically positioned in parallel with respect to the shaft, each of the at least two chambers including a slot for receiving a Microtiter plate; and actuating said motor assembly and centrifuging the at least two plates.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE INVENTION

The terms "a" or "an" as used herein are to describe elements and components of the invention. This is done merely for convenience and to give a general sense of the invention. The description herein should be read to include one or at least one and the singular also includes the plural unless indicated to the contrary.

The term "comprises", "comprising", "includes", "including", "as", "having", or any other variation thereof, are intended to cover non-exclusive inclusions. For example, a process, method, article or apparatus that comprises a list of elements is not necessarily limited to only those elements but may include other elements not expressly listed or inherent to such process, method, article, or apparatus. In addition, unless expressly stated to the contrary, the term "or" refers to an inclusive "or" and not to an exclusive "or". For example, a condition A or B is satisfied by any one of the following: A is true (or present) and B is false (or not present); A is false (or not present) and B is true (or present); and both A and B are true (or present).

Figure 1:
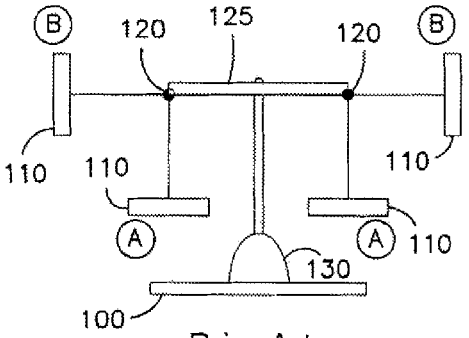
Prior Art FIG. 1
FIG. 1 illustrates a conventional Microtiter plate/PCR plate centrifuge.

FIG. 1 illustrates a cross-section view of a conventional Microtiter/PCR plate centrifuge 100, wherein generally oppositely positioned horizontal trays 110 (position A) are attached via a gimbaled or hinged connection 120 to a rotatable arm 125. As the rotatable arm 125 is spun up to a desired speed, by an application of an input voltage (not shown) to a motor unit 130, the horizontal trays 110 are swung out to a substantially vertical position (position B). While in this vertical position, any PCR plate (not shown) positioned within trays 110 are also vertically positioned and centrifugal force forces solid materials within the PCR plates to be forced to the bottom of the vials within the PCR plates.

Figure 2:
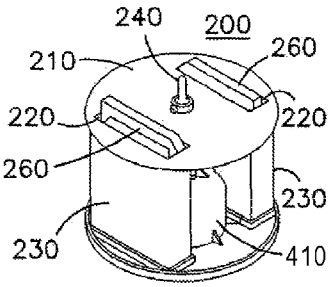
FIG. 2 illustrates a perspective view of an exemplary embodiment of a PCR plate centrifuge rotor in accordance with the principles of the invention.

FIG. 2 illustrates a perspective view of an exemplary embodiment of a Microtiter/PCR plate centrifuge rotor 200 in accordance with the principles of the invention. In this exemplary embodiment, a top, rotatable, plate 210 (i.e., a rotor) includes at least one set of substantially oppositely positioned slots 220. Slots 220 represent openings to vertically positioned chambers 230. Plate 210 is further connected to a shaft 240 which is attached to motor assembly 250. Also shown are PCR plates 260 vertically inserted into chambers 230 through openings (slots) 220. In one aspect of the invention, the set of slots 220 is symmetrically positioned with respect to the shaft connection to plate 210.

Figure 3:
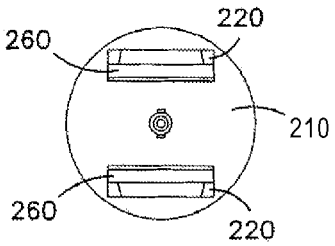
FIG. 3 illustrates a top view of a plate holding rotor of the exemplary PCR plate centrifuge rotor shown in FIG. 2.

FIG. 3 illustrates a top view of the rotatable plate 210 showing the one set of oppositely positioned slots 220 leading to corresponding chambers, with plates 260 positioned in chambers 230. The use of oppositely positioned chambers provides for balancing of the spinning rotatable plate 210 to avoid vibrations. In addition, one skilled in the art would recognize that more than one set of oppositely positioned slots 220 may be incorporated into plate 210. The number of sets may depend on the size of plate 210, the size of slot 210 and the orientation of adjacent slots.

Figure 4:
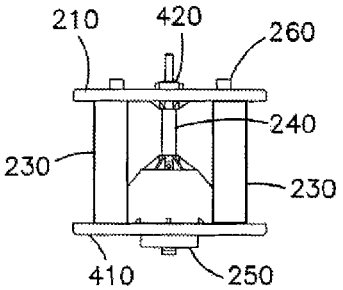
FIG. 4 illustrates a side view of the exemplary PCR plate centrifuge rotor shown in FIG. 2.

FIG. 4 illustrates a side view of the exemplary Microtiter plate centrifuge rotor shown in FIG. 2. As illustrated, extending substantially perpendicular from top rotatable plate (rotor) 210 are chambers (channels) 230. Plate 210 is held in position on shaft 240 by containment devices 420. Shaft 240 is attached to motor assembly 250.

Also shown is bottom plate 410, attached to shaft of the rotor assembly 200, which provides a housing for the motor assembly 250. Bottom plate 410 may further be attached or coupled to a lower end of channels (chambers) 230 to retain channels 230 in a rigid configuration. In this case, the assembly of top plate 210, channels 230 and bottom plate 410 responds as a single unit as the motor assembly 250 causes the rotation of top plate 210.

Figure 5:
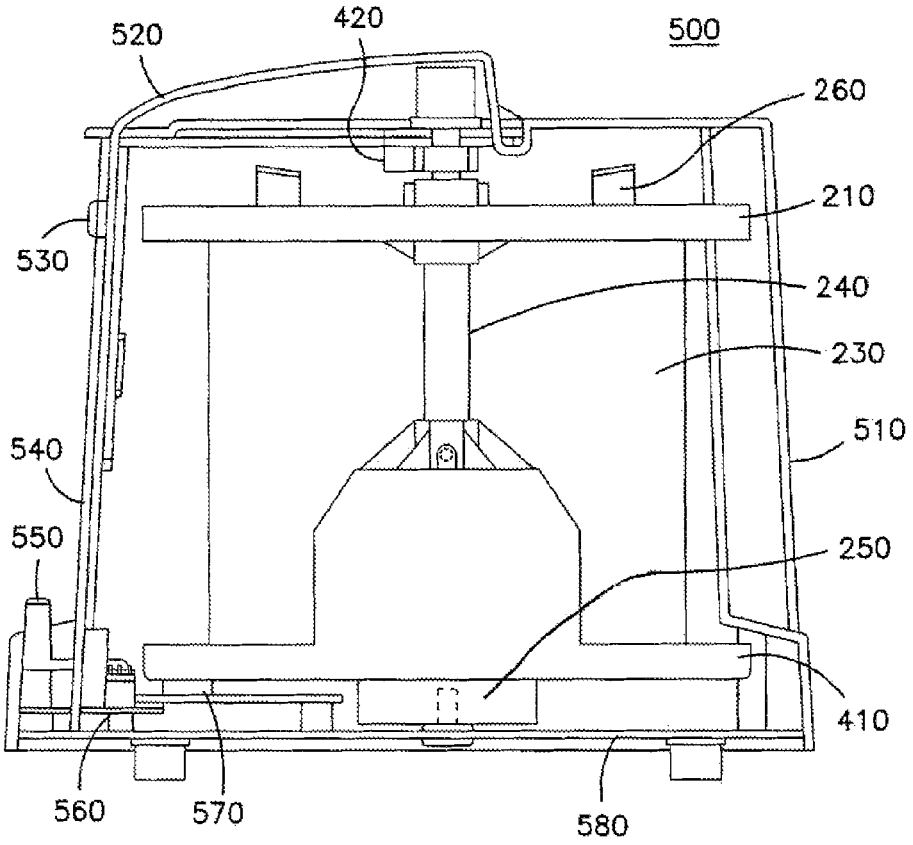
FIG. 5 illustrates a cross-sectional view of the exemplary embodiment of the invention shown in FIG. 2.

FIG. 5 illustrates a cross-sectional view of device 500 incorporating the vertical plate centrifuge rotor 200 shown in FIG. 2. Device 500 includes a housing 510 attached to a base plate 580. A lid 520, having a hinged attachment to body (housing) 510 allows access to slot 220 in rotor assembly 200 through an opening in housing 510. In one aspect, lid 520, when open, allows access to at least one slot 220 in top plate 210. The top plate 210 may be manually rotated to allow access to another one of the slots in top plate 210.

Also shown is lid open button 530, which is used to open lid 520. Lid 520 may be spring loaded and when the lid open button 530 is depressed, lid 520 springs open. In addition, when lid 520 is closed, sliding switch 540 is engaged. Sliding switch 540 acts as a safety switch to prevent activation of the motor assembly 250 unless the lid is in a closed position. That is, sliding switch 540 prevents/allows a voltage to be applied to run switch 550. Thus, run switch 550 operates in conjunction with slide switch 540 to apply a voltage to motor assembly 250. In addition, when run switch 550 is depressed and held, a brake pad 570, which normally engages bottom plate 410, is moved away from bottom plate 410 to allow bottom plate 410 to rotate as motor assembly 250 causing top plate 210 to rotate. When pressure is removed from run switch 550, brake pad 570 returns to its original position against bottom plate 410. Brake pad 570 creates friction that acts to slow down and stop the rotation of bottom plate 410. As would be recognized, brake pad may be held in a normally engaging position by a spring mechanism (not shown).

Although switch 550 is described as a momentary switch, it would be recognized that switch 550 may be a toggle switch, wherein one depression acts to activate the motor assembly 250 and position brake pad 570 away from the bottom plate 410 and a second depression causes deactivation of the motor assembly 250 and brake pad 570 is positioned against bottom plate 410 via brake arm 560. In one aspect the switch 550 may be a single-pole switch that allows voltage to be applied to motor assembly 250 when in a closed position (for a normally open switch) and in an open position (for a normally closed switch).

Figure 6:
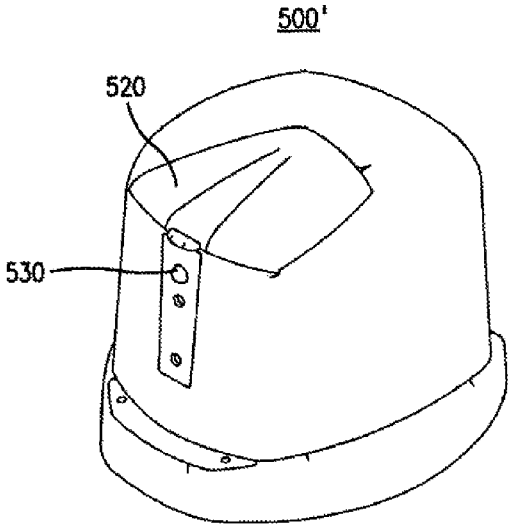
FIG. 6 is an elevational view of the device according to an aspect of the invention.
Figure 7:
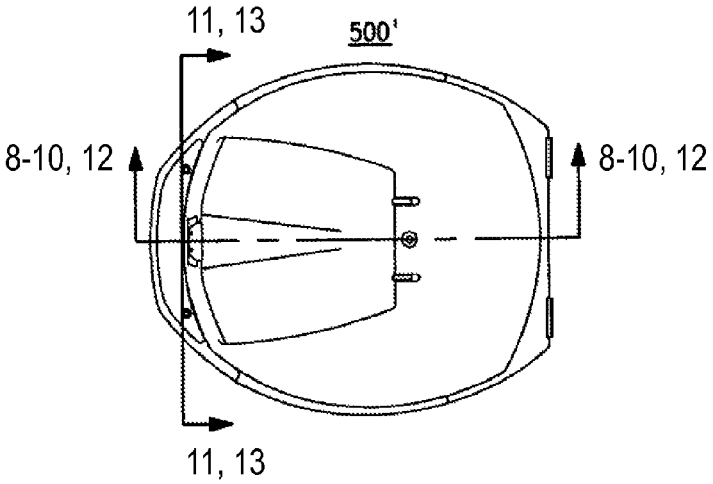
FIG. 7 is a top plan view of the device of FIG. 6.

Referring to FIGS. 6 and 7, the elevational and top plan views, respectively, of the device 500' according to an aspect of the invention are illustrated. Cross-sectional views of the device of FIGS. 6 and 7, taken along lines 8-8, 9-9, 10-10 and 12-12 of FIG. 7 are illustrated in FIGS. 8-10 and 12, respectively. Cross-sectional views of the switching mechanism, taken along lines 11-11 and 13-13 of FIG. 7, are illustrated in FIGS. 11 and 13, respectively.

Figure 8:
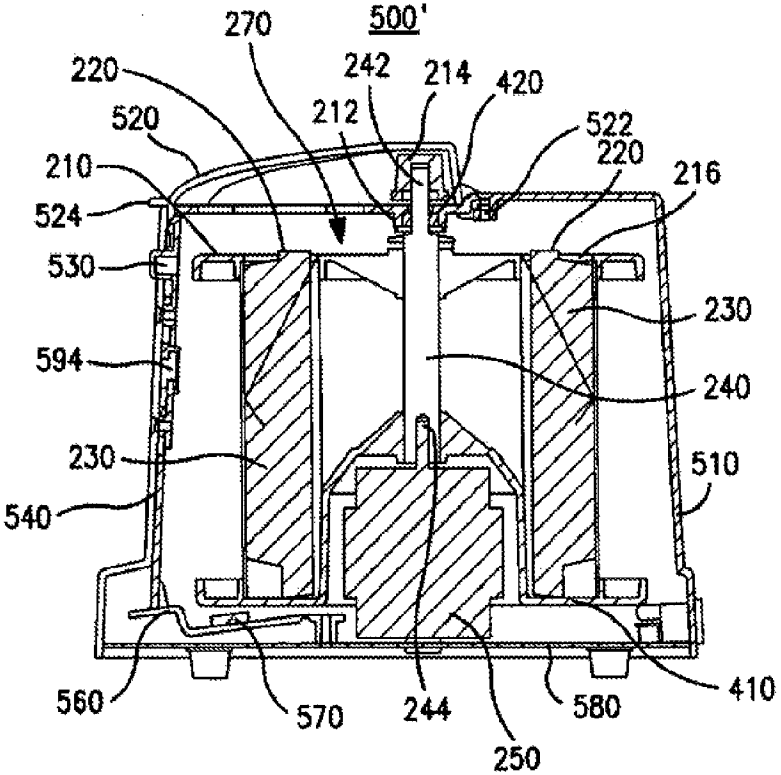
FIG. 8 is a cross-sectional view of the device according to an aspect of the invention, taken along line 8-8 of FIG. 7, illustrating the lid in a closed position.

Referring to FIG. 8, the device 500' includes a housing 510 attached to a base plate 580. A top rotor plate 210 disposed adjacent the top of rotor assembly 270 includes one or more substantially oppositely disposed sets of slots 220 extending downwardly from the top surface 216 of the plate 210. Slots 220 represent openings to vertically positioned chambers 230. Plate 210 is connected by containment devices 420 to the distal end 242 of a shaft 240 which proximal end 244 is attached to motor assembly 250. The plate 210 is supported adjacent the top of the device 500' by containment devices 420 including a bearing 212 and a knob 214 coupling the plate 210 to shaft 240. When the lid 520 is in the open position (FIG. 9), the knob 214 may be used to manually rotate the rotor plate 210 of the rotor assembly 270 to access the slots 220. A Microtiter or PCR plate 260 may be vertically inserted into chambers 230 through slots 220. In one aspect of the invention, the set of slots 220 is substantially symmetrically positioned in parallel with respect to the shaft 240 and substantially symmetrically positioned substantially perpendicular to the plate 210.

In FIG. 8, the rotor assembly 270 may further include bottom plate 410, which includes a housing for motor assembly 250. Bottom plate 410 may further be coupled to a lower end of chambers 230 to retain the chambers 230 in a rigid configuration. In this aspect, the assembly of top plate 210, chambers 230 and bottom plate 410 responds and rotates as a single unit upon activation of the motor assembly 250.

Still referring to FIG. 8, the lid 520 is illustrated in a closed position on the device 500'. In this aspect of the invention, the sliding switch bar 540 operates without run switch 550 to actuate the device 500' as will be described. In the closed position, the switch bar 540 is in a first position to actuate flexible brake arm 560 via sliding switch bar 540. Upon closing the lid, the flexible brake arm 560 moves downwardly from the second position (illustrated in FIG. 9) to the first position via the sliding switch bar 540, and, at the first position, disengages the brake pad 570 from the rotor assembly 270, engages (closes) run switches 550' and 550", as illustrated in FIG. 11, and the device 500' begins the centrifugation process.

Figure 9:
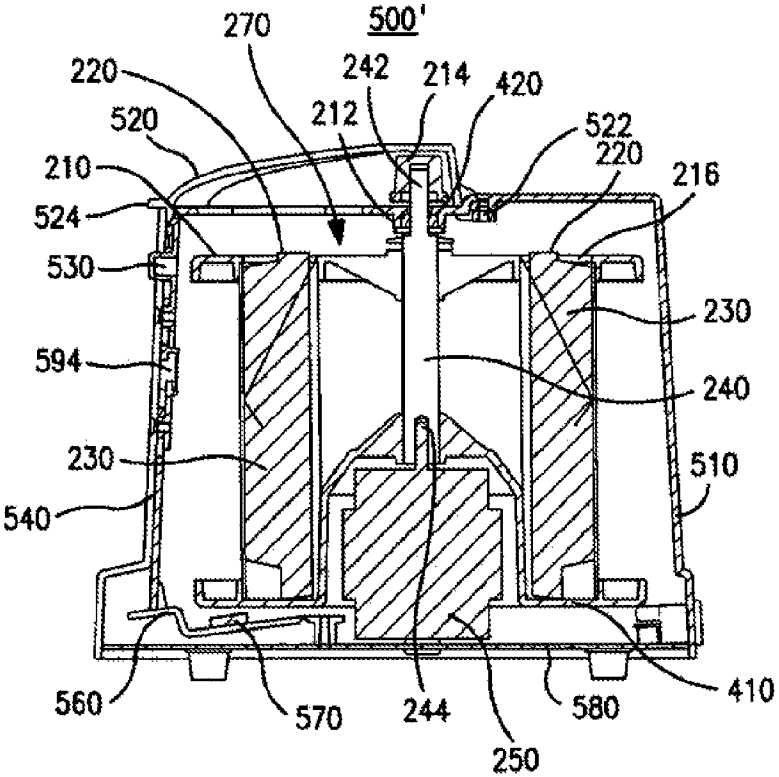
FIG. 9 is a cross-sectional view of the device according to an aspect of the invention, taken along line 9-9 of FIG. 7, illustrating the lid in an open position.

Referring to FIG. 9, the lid 520 is illustrated in an open position on the device 500'. To open the lid 520, an operator may push the lid open button 530. As illustrated, the spring-loaded lid 520 is attached via hinged attachment 522, and as the lid open button 530 is pressed, the sliding switch bar 540 moves upwardly, pushing the lid tab 524 upwardly upon release of the lid tab 524 from the latch hook 592 of the fixed latch bar 590, and a coiled spring 594 on a fixed latch bar 590 allows the lid 520 to essentially "spring" open. In the lid-open position, the switch bar 540 has been moved upwardly from the first position (illustrated in FIG. 8) to the second position illustrated in FIG. 9, which allows flexible brake arm 560 to return to the second position by which the brake pad 570 engages with the base plate 410 of the rotor assembly 270, and the switch bar 540 disengages (opens) switches 550' and 550", as illustrated in FIG. 13. When engaged by the switch bar 540, the switches 550' and 550" operate in conjunction with a printed circuit board 596 to apply a voltage to motor assembly 250.

Figure 10:
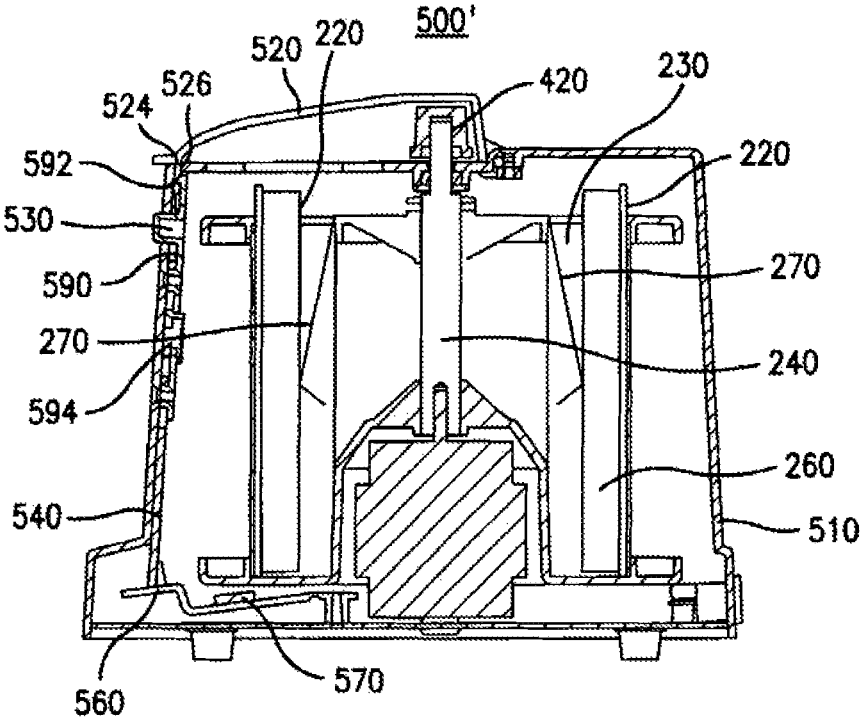
FIG. 10 is a cross-sectional view of the device, taken along line 10-10 of FIG. 7, according to an aspect of the invention illustrating the lid in a closed position, and Microtiter plates disposed in the device.
Figure 11:
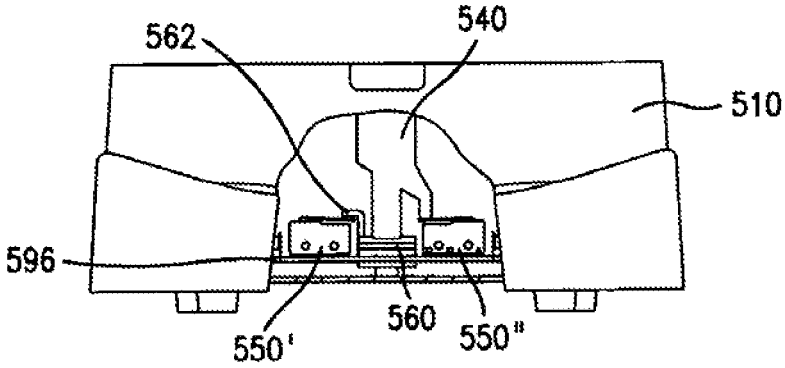
FIG. 11 is a cross-sectional view of the switching mechanism according to an aspect of the invention taken along line 11-11 of FIG. 7.

Referring to FIG. 10, Microtiter plates 260 are disposed in the chambers 230 of the device 500', and are retained in an upright, vertical position with retaining means 270. The retaining means 270 of FIG. 10 are illustrated as flexible spring arms, but may include other conventional means known to those skilled in the art for retaining devices in an upright position. Although the chambers of the embodiment of FIG. 5 suitably retain the plates in a substantially vertical position, advantageously, it has been found that the flexible spring arms do not interfere with the insertion and removal of Microtiter plates in the device, regardless of the plate height, and do not require additional adjustments or mechanisms to maintain the plates in an upright vertical position.

Still referring to FIG. 10, a lid latching system is also illustrated. In the system, with the lid being moved to a closed position, a lid tab 524 serves to push the sliding switch bar 540 down from a second position (when the lid is open) to a first position (when the lid is closed). A latch hook 592 disposed on a fixed latch bar 590 cooperates with a recess 526 on the lid tab 524 and maintains the lid in a closed position, and simultaneously, as the lid is closed, the sliding switch bar 540 moves downwardly from the second position (illustrated in FIG. 9) to a first position (illustrated in FIG. 8), and, at the first position, activates a flexible brake arm 560 which moves downwardly to disengage the brake pad 570 and closes switches 550' and 550". As illustrated in FIG. 11, switch 550' is closed via an extension 562 on the flexible brake arm 560', and switch 550" is closed via the sliding switch bar 540.

Figure 12:
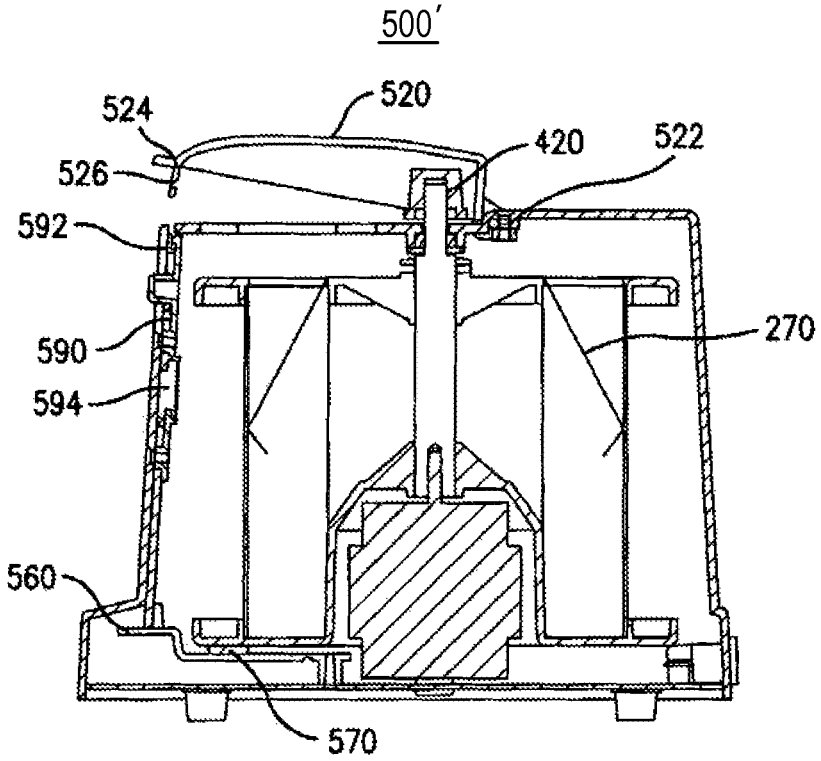
FIG. 12 is a cross-sectional view of the device, taken along line 12-12 of FIG. 7, according to an aspect of the invention illustrating the lid in an open position.
Figure 13:
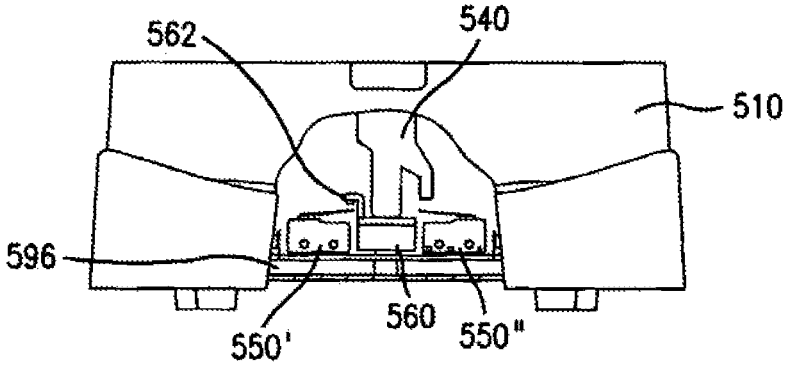
FIG. 13 is a cross-sectional view of the switching mechanism according to an aspect of the invention taken along line 13-13 of FIG. 7.

Referring to FIG. 12, the lid latching system is further illustrated. In the system, to move the lid to an open position, the lid open button 530 is pushed to release the latch hook 592, which disengages the latch hook 592 from the recess 526 on the lid tab 524. As the lid is coupled to the housing via a hinged attachment 522, and the fixed latch bar 590 includes a coiled spring 594, when the lid open button 530 is pushed inwardly, the sliding switch bar 540 moves upwardly, and the lid 520 essentially "springs" open, as described previously. In the device 500' illustrated in FIG. 12, the Microtiter plates 260 have been removed, and the retaining means 270 are shown in a second position adjacent an interior wall of each chamber 230.

Upon pipetting a sample substance into a Microtiter plate, small amounts of the sample may remain on the side of a well, or bubbles may be present. For example, with PCR plates, less than 200 microliters of a sample substance is placed in each cone-shaped well. The wells are small, and due to the small size, the surface tension of a liquid sample keeps the sample in the well, without needing to seal the open wells. Advantageously, when using PCR plates or conventional Microtiter plates in the device, the plates are inserted vertically, and remain in a vertical position throughout the entire process. The result of the centrifugation is that all or substantially all of the sample is moved to the bottom portion of the sample wells of the plates, in contrast to conventional centrifuge devices, where the separation of components of a sample substance (for example, blood) is accomplished. In addition, it should be understood that the microtiter plates and PCR plates have small diameters across each well. Since the centrifuge operates at a speed of approximately 2500 r.p.m., and at a G force of approximately 500×gravity, the G force exerted on the sample is relatively low, i.e., a few hundred Gs, to push the sample to the bottom of the wells. Concentration or consolidation of the sample at the bottom of the well of a Microtiter or PCR plate results in a more uniform sample for any required further processing, for example, thermal cycling for a PCR reaction, or fluorescence or luminescence detection for a microplate reader.

While there has been shown, described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

It should be understood that the various aspects of the present invention described herein are merely exemplary and that a person skilled in the art may make many variations and modifications to the described embodiment utilizing functionally equivalent components to those described. As such, variations and modifications, including differing physical geometries, proportions and materials are intended to be included within the scope of the invention as defined in the appended claims.

Benefits, other advantages, and solutions to problems have been described above with regard to specific embodiments. The benefits, advantages, solutions to problems and any element(s) that may cause any benefit, advantage, or solution to occur or become more pronounced are not to be construed as a critical, required, or essential feature or element of any or all of the claims.

What is claimed is:

1. A centrifuge for holding microtiter plates, comprising:

a motor assembly including a shaft extending vertically therefrom;

a rotor assembly coupled to said motor assembly via said shaft of said motor assembly, said rotor assembly comprising:

a bottom plate disposed adjacent to said motor assembly, said bottom plate including a centrally-located aperture for receiving said motor assembly;

a rotor plate disposed adjacent an end of said shaft; and at least two vertical chambers extending in a perpendicular direction from a surface of said rotor plate, said at least two chambers substantially symmetrically positioned in parallel with respect to said shaft, each of said at least two chambers including a slot configured for receiving a microtiter plate;

means for applying a voltage to said motor assembly;

a brake pad engaging said bottom plate in a first position; and means for disengaging said brake pad.

2. The centrifuge according to claim 1, wherein each of said vertical chambers is coupled to said bottom plate.

3. The centrifuge according to claim 1, wherein the means for applying voltage comprises one or more switches.

4. The centrifuge according to claim 1, wherein said brake pad is mounted on a brake arm.

5. The centrifuge according to claim 1, further comprising:

a housing with an opening;

a lid coupled to said housing for covering said opening in said housing; and means for opening and closing said lid.

6. The centrifuge according to claim 5, wherein the means for opening and closing said lid comprises a sliding switch bar.

7. The centrifuge according to claim 1, further comprising means for retaining a microtiter plate in each of said chambers.

8. A vertical microtiter plate centrifuge assembly, comprising:

a housing including an opening;

a lid coupled to said housing for covering said opening in said housing;

means for opening and closing said lid; and a centrifuge assembly disposed within said housing, id centrifuge assembly comprising:

a motor assembly attached to and vertically positioned with respect to a bottom of said housing, said motor assembly including a shaft extending vertically therefrom;

a rotor assembly coupled to said motor assembly via said shaft of said motor assembly, said shaft having a first end and a second end, said rotor assembly comprising:

a bottom plate disposed adjacent to said motor assembly, said bottom plate including a centrally-located aperture for receiving said motor assembly;

a rotor plate disposed adjacent said first end of said shaft; and at least two vertical chambers extending in a perpendicular direction from a surface of said rotor plate, said at least two chambers substantially symmetrically positioned in parallel with respect to said shaft, each of said at least two chambers including a slot for receiving a microtiter plate;

means for applying a voltage to said motor assembly;

a brake pad engaging said bottom plate in a first position; and means for disengaging said brake pad.

9. The centrifuge assembly according, to claim 8, wherein each of said chambers is coupled to said bottom plate.

10. The centrifuge assembly according to claim 8, wherein the means for applying a voltage comprises one or more switches.

11. The centrifuge assembly according to claim 8, wherein said brake pad is mounted on a flexible brake arm.

12. The centrifuge assembly according to claim 8, wherein said means for opening and closing said lid comprises a sliding switch bar.

13. The centrifuge assembly according to claim 8, further comprising means for retaining a microtiter plate in each of said chambers.

14. A method for centrifuging microtiter plates, comprising:

disposing at least two microtiter plates containing sample substances into a centrifuge, said centrifuge comprising:

a motor assembly including a shaft extending vertically therefrom;

a rotor assembly coupled to said shaft via said shaft aid motor assembly, said rotor assembly comprising:

a bottom plate disposed adjacent to said motor assembly, said bottom plate including a centrally-located aperture for receiving said motor assembly;

a rotor plate disposed adjacent an end of said shaft; and at least two vertical chambers extending in a perpendicular direction from a surface of said rotor plate, said at least two chambers substantially symmetrically positioned in parallel with respect to said shaft, each of said at least two chambers including a slot configured for receiving a microtiter plate; and a brake pad engaging said bottom plate in a first position with means for disengaging said brake pad;

applying voltage to said motor assembly; and actuating said motor assembly and centrifuging aid at least two microtiter plates.

15. A centrifuge for holding microtiter plates, comprising:

a motor assembly including a shaft extending vertically therefrom;

a rotor assembly coupled to said motor assembly via said shaft of said motor assembly, said rotor assembly comprising:

a bottom plate disposed adjacent to said motor assembly, said bottom plate including a centrally-located aperture for receiving said motor assembly;

a rotor plate disposed adjacent an end of said shaft; and at least two vertical chambers extending in a perpendicular direction from a surface of said rotor plate, said at least two chambers substantially symmetrically positioned in parallel with respect to said shaft, each of said at least two chambers including a slot configured for receiving a microtiter plate;

at least one voltage applicator for applying a voltage to said motor assembly;

a brake pad engaging said bottom plate in a first position; and a sliding switch bar for disengaging said brake pad.

16. A vertical microliter plate centrifuge assembly, comprising:

a housing including an opening;

a lid coupled to said housing for covering said opening in said housing; and a centrifuge disposed within said housing, comprising:

a motor assembly attached to and vertically positioned with respect to a bottom of said housing, said motor assembly including a shaft extending vertically therefrom; and a rotor assembly coupled to said motor assembly via said shaft of said motor assembly, said shaft having a first end and a second end, said rotor assembly comprising:

a bottom plate disposed adjacent to said motor assembly, said bottom plate including a centrally-located aperture for receiving said motor assembly;

a rotor plate disposed adjacent said first end of said shaft; and at least two vertical chambers extending in a perpendicular direction from a surface of said rotor plate, said at least two chambers substantially symmetrically positioned in parallel with respect to said shaft, each of said at least two chambers including a slot for receiving a microtiter plate;

at least one voltage applicator for applying a voltage to said motor assembly;

a brake pad engaging said bottom plate in a first position; and a sliding switch bar for opening and closing said lid and for engaging and disengaging said brake pad.

17. A method for centrifuging microtiter plates, comprising:

disposing at least two microtiter plates containing sample substances into a centrifuge, said centrifuge comprising:

a motor assembly including a shaft extending vertically therefrom;

a rotor assembly coupled to said shaft via said shaft of said motor assembly, said rotor assembly comprising:

a bottom plate disposed adjacent to said motor assembly, said bottom plate including a centrally-located aperture for receiving said motor assembly;

a rotor plate disposed adjacent an end of said shaft; and at least two vertical chambers extending in a perpendicular direction from a surface of said rotor plate, said at least two chambers substantially symmetrically positioned in parallel with respect to said shaft, each of said at least two chambers including a slot configured for receiving a microtiter plate;

a brake pad engaging said bottom plate in a first position; and a sliding switch bar for disengaging said brake pad;

applying voltage to said motor assembly; and actuating said motor assembly and centrifuging said at least two microtiter plates.

* * * * *

UNITED STATES PATENT AND TRADEMARK OFFICE

CERTIFICATE OF CORRECTION

PATENT NO. : 9,050,608 B2
APPLICATION NO. : 12/807596
DATED : June 9, 2015
INVENTOR(S) : Michael D Rosenblum et al.

It is certified that error appears in the above-identified patent and that said Letters Patent is hereby corrected as shown below:

On the title page item (62), should read:

Continuation-in-part of application No. 12/317,880, filed on Dec. 30, 2008, now abandoned.

Signed and Sealed this
Twenty-second Day of December, 2015

Michelle K. Lee

Michelle K. Lee
*Director of the United States Patent and Trademark Office*